United States Patent [19]

Diamond

[11] Patent Number: 4,641,765

[45] **Date of Patent: * Feb. 10, 1987**

[54] EXPANDABLE PRESSURIZED BARRIER CONTAINER

[76] Inventor: George B. Diamond, Anthony & Woodglen Rds., Glen Gardner, N.J. 08826

[ * ] Notice: The portion of the term of this patent subsequent to Jan. 7, 2003 has been disclaimed.

[21] Appl. No.: 771,491

[22] Filed: Sep. 5, 1985

Related U.S. Application Data

[63] Continuation-in-part of Ser. No. 658,274, Oct. 5, 1985, Pat. No. 4,562,942, which is a continuation-in-part of Ser. No. 627,431, Jul. 3, 1984, abandoned.

[51] Int. Cl.[4] ..... B67D 1/04

[52] U.S. Cl. ..... 222/386.5; 222/389

[58] Field of Search ..... 222/92, 94, 105, 107, 222/130, 386, 386.5, 389, 394, 402.1

[56] References Cited

U.S. PATENT DOCUMENTS

| | | | |
|---|---|---|---|
| 3,070,265 | 12/1962 | Everett | 222/386.5 |
| 3,931,834 | 1/1976 | Caillet | 222/386.5 X |
| 3,940,031 | 2/1976 | Fishman | 222/386.5 |
| 4,171,757 | 10/1979 | Diamond | 222/389 |
| 4,308,973 | 1/1982 | Irland | 220/454 |
| 4,562,942 | 1/1986 | Diamond | 222/386.5 |

*Primary Examiner*—Charles A. Marmor
*Assistant Examiner*—Michael S. Huppert
*Attorney, Agent, or Firm*—Ostrolenk, Faber, Gerb & Soffen

[57] ABSTRACT

A pressurized thin walled expandable can from which a fluent pressurized product is dispensed is made from an expandable can wall and a barrier, which may be a fully evertable bag having uniform thickness and flexibility and shaped to fit within the can wall. The open end of the bag is mounted to the can wall by apparatus which maintain a seal as the can wall expands and returns to its unexpanded condition. As product to be dispensed is introduced into the product chamber, the flexible bag is extended down into the lower end of the can. As the product is later expelled through a discharge opening, the flexible bag, which may be plastic, is fully everted into the upper end of the can to expel all the product. The can is thin walled, so that when pressurized, the can diameter expands by at least one one-thousandth (1/1000) of its unexpanded value. In one embodiment, the bag is mounted by a ring inside the can. The ring includes a portion which expands to maintain the seal with the expanding can side wall. In another embodiment the ring is rigid, but of slightly larger diameter than the can. This ring stretches the can, so as to maintain the sealing contact with the can as the can expands. In other embodiments, the bag may be mounted by a stretchable adhesive and, if the bag is slightly elastic, it may be mounted by an adhesive or by a melt seal process such as heat sealing.

16 Claims, 9 Drawing Figures

10
12
16
17
18
19
20
21
24
26
30
32
34
36
37
38
39
40

FIG. 6
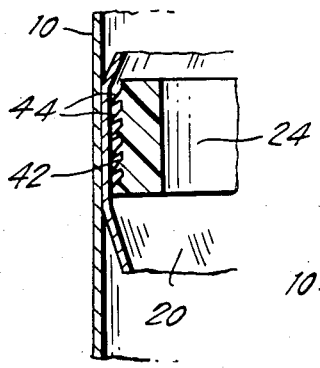
FIG. 8
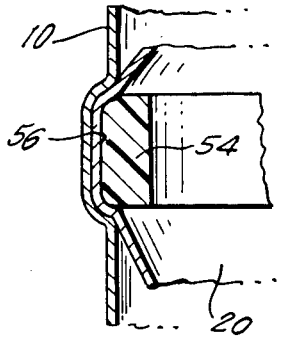
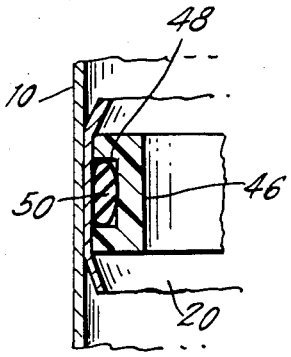
FIG. 7
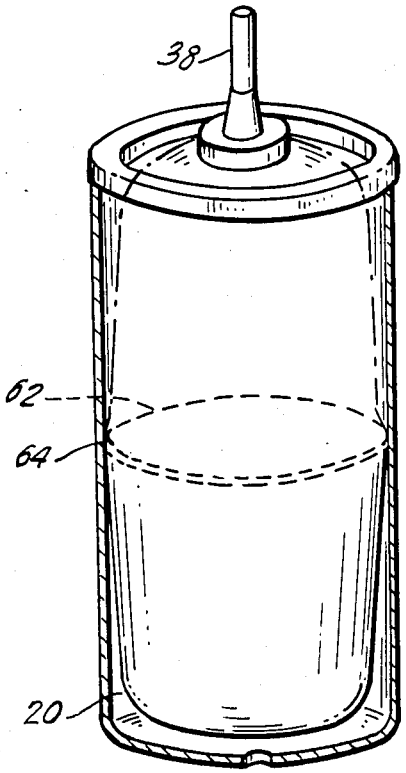
FIG. 9

EXPANDABLE PRESSURIZED BARRIER CONTAINER

CROSS REFERENCE TO RELATED APPLICATION

This is a continuation-in-part of application Ser. No. 658,274, filed Oct. 5, 1985, now U.S. Pat. No. 4,562,942, which is in turn a continuation-in-part of application Ser. No. 627,431, filed July 3, 1984, now abandoned.

BACKGROUND OF THE INVENTION

This invention relates to a pressurized can from which a fluent product is dispensed by actuating a product discharge valve, and particularly, a pressurized can having a barrier which separates the product from a pressurized gaseous or liquefied propellant.

Pressurized cans are used for dispensing liquid, semiviscous and viscous products. A can from which a liquid product is dispensed is often called an aerosol can. In some of these cans, in order to prevent cavitation, a barrier separates the product from the propellant. Three basic types of barriers in pressurized cans have typically been used, a piston system, a sprayed on strippable film bag, or a bay system.

In the piston system, a free piston, which is shiftable along the interior of the can, is the barrier. See U.S. Pat. No. 4,171,757. The piston system works for many products, but because the piston does not create an impenetrable barrier at the can wall, this system should not be used for products which may bypass the piston. Furthermore, the piston system is also ineffective with certain limited types of seamed cans, oddly shaped cans, cans that change in cross-section over the height of the can, and misshapen cans, since the barrier piston then has difficulty sealing to the wall of the can as the piston moves.

In the strippable film system, a plastic composition is sprayed onto the peripheral side wall and the bottom wall of the can. As the product is expelled from the can, the film is pushed up by the pressurized propellant beneath it, and the film gradually strips away from the sides and bottom of the can to push the product out. Because the bag is being stripped away from the bottom upwardly, the bag cannot be "pinched-off" and a cut off in the flow of the product is avoided. To ensure even stripping of the bag, the can should be relatively rigid. The strippable film arrangement has a relatively expensive fabricating process.

The bag system may be made in a number of ways. In one variant, a bag is inserted into the can and it is either brought out and around the lip of the can or it is sealed to the chime or top rim of the can. In either case, special folds or pleats formed in the bag or a collecting tube in the bag are necessary to prevent the bag from collapsing and pinching or cutting off the flow of the product, especially as the bag collapses toward the top of the can under pressure while the product is being expelled. The bag system of this variant tends to be expensive because the bags have to be made with either folds or pleats to avoid the "pinching-off" problem. A further disadvantage of this bag system is that bags which are connected at their opening to the lip or chime of the cans tend to both collapse and tear off at the chime or at the seams. Although inserting a collecting tube into the bag may overcome some of these problems, the increased cost tends to make this approach impractical.

In a modification of the just described bag system, the bag is simply secured at the top or the bottom of the can, without being a specially designed bag, but this system is not capable of fully expelling all of the contents of the can.

In another variant of the bag system, the bag is fixedly secured part way along the height of the can, between the ends of the can. In typical examples of this system, the position of the bag along the height of the can is predetermined, before can assembly and filling, by the bag being secured between bottom and top halves of a two part container, by an attachment fixture in the can, or by slots or grooves in the can which fix the location of the bag. Such a bag may be capable of everting for expelling all of the contents of the can. But, this variant is not universally efficient for all pressures or all materials being expelled, for all types of propellants or all sizes of cans, and assembly of a can with such a bag system may be difficult or expensive.

Different propellants, e.g. a gaseous propellant or a liquid propellant, require that they occupy quite different percentages of the total volume of a can, as discussed in more detail below. For any particular size can, where the position of the bag along the can is predetermined by the can design, it is necessary for a manufacturer to design and inventory different sets of cans for differently positioned bags in the cans. A can which is more universally usable would be preferred.

Conventional cans used in the bag system are relatively thick and rigid. In some cases, this is necessary to maintain the seal between the bag and the can wall.

It would be advantageous to provide a pressurized barrier container using a thin, expandable can wall, which would be substantially less expensive than a conventional thick, rigid can wall. In addition, it would be advantageous to provide such a container which could be used with an inexpensive barrier mounted in a simple manner to the can wall.

SUMMARY OF THE INVENTION

It is an object of the pr sent invention to provide a pressurized can with a barrier system which may be used with a thin expandable can wall in which an inexpensive barrier is mounted in a simple manner.

Another object of the invention is to provide a barrier which dispenses the entire product contents of a pressurized can without trapping product in the can.

It is a further object of the invention to provide a barrier system which may be used with a great variety of cans, including cans which are oddly shaped.

Another object of the invention is to provide an effective barrier in an expandable can between the product to be dispensed and the pressurized dispensing propellant.

It is still a further object of the invention to provide a barrier system which can be firmly and immovably attached to the peripheral side wall of the can to avoid sealing problems.

Yet a further object of the invention is to provide a barrier system using a flexible barrier which can be easily disposed at any selected location along the height of the can.

Another object of the invention is to assure that the flexible barrier positioned in the can will remain sealed to the side wall of the can even as the pressure in the can causes its walls to expand.

A pressurizable container according to the invention comprises an expandable can wall and a barrier. The barrier is mounted to the can wall by means which ensure that a seal is maintained as the can wall expands due to pressure.

More specifically, the invention provides a barrier system for an expandable pressurized can from which a fluent product is dispensed under pressure through a discharge opening in the can. The can has a wall which surrounds a can chamber and has the discharge opening at its upper end. The can side walls are thin enough that under pressures to which the contents of the can are pressurized, the side walls will flex and expand outwardly slightly. The diameter of the wall across the can may increase by at least one one-thousandth (1/1000) of its unexpanded value as the pressure goes from zero to 100 psi.

A flexible barrier, such as a bag in the shape of a cup, is mounted in the can to divide the can chamber into a product chamber above the barrier and a propellant chamber below the barrier. The barrier is impervious to the product being dispensed and to the propellant for dispensing it. The flexible barrier is sealed to the peripheral wall of the can by sealing means to guarantee that neither the propellant nor the product can leak past the seal, and the seal is maintained according to the invention even when the can pressure causes the can walls to flex and expand. The barrier is mounted in the can so that it everts as the product is dispensed from the can.

The sealing means may comprise a fairly rigid ring of plastic, or the like, which is disposed inside the open peripheral edge of the barrier. The ring has a peripheral exterior shaped and sized for snugly fitting against the inner surface of the side wall of the can. The ring is inserted into the barrier, and the ring inside the barrier presses against the side wall of the can. The ring is placed in the can at a height which will allow the barrier to be everted.

As the can walls are flexible and are expected to flex slightly when the can is pressurized, the ring must assure the continuing seal between the product and propellant chambers, respectively above and below the barrier. Appropriate means comprising at least one of either the can wall and the inserted ring are stressed and deformed before the can is pressurized such that upon pressurization of the can and slight expansion of its side wall, the seal is still maintained.

In one embodiment, the ring includes expansible wall engaging means at its periphery which are sized so that when the ring is installed in the can before the can wall has expanded, the expansible means on the ring are compressed and deformed by the contact with the wall of the can. For example, a plurality of resilient annular ridges or flanges may be defined on the ring periphery. The flanges normally have a fully extended diameter greater than the expanded diameter of the can wall. Upon pressurization of the can, with corresponding expansion of its flexible wall, the expansible means, i.e. the flanges on the ring, expand or flex outwardly to maintain contact and seal with the wall. In an alternate embodiment, the periphery of the ring includes a receptacle, such as a groove, for receiving an expansible means, such as a separate, expansible and compressible O-ring. The O-ring is of a diameter to be compressed when the sealing ring is inserted in the can. The O-ring is expansible to maintain a seal with the side wall of the can when the can expands.

In a second embodiment of the sealing means, the ring is rigid and its periphery is rigid. However, the ring diameter is selected to be slightly greater than the diameter of the can when the can is unpressurized. As the ring is installed by pushing it into the can, it deforms the side wall outwardly. Wherever the ring is lodged along the height of the can, the can will be slightly deformed outwardly at that location. The extent to which the ring diameter is greater than that of the can is only slight. Too great a difference in these diameters would permanently deform the can wall to a new shape, and upon pressurization, the seal between the can wall and the ring would be broken. However, slight deformation fo the can wall would not cause a permanent change in shape of the can wall. When this can is pressurized, its wall above and below the ring expands, while the slightly deformed section of the can wall at the ring does not correspondingly expand, and the can to ring seal is thereby maintained.

The sealing means may take other forms, provided that the seal is maintained as the can wall expands. In an additional embodiment, a stretchable adhesive is used which stretches as the can wall expands without cracking or otherwise breaking the seal. In another additional embodiment, the barrier itself is sufficiently stretchable that the sealing means may be a direct mounting of the barrier to the wall by adhesive or by a melting process such as heat sealing.

In one embodiment, the flexible barrier is formed from a sheet with a surface area which is greater than the transverse cross-section of the can. The sheet may form a bag in the shape of a cup. The flexible barrier is extendible into the can below the ring when the can is filled with product, and is extendible above the ring through the pressure exerted by the propellant in the propellant chamber as product is being expelled from the product chamber. The flexible barrier is everted above the ring and pushes the product out until substantially all of the product has been expelled.

The can is fitted with an upper cover which also supports a discharge valve through which the product is eventually expelled. The can is filled with product up to the underside of the cover. The upper cover may be in the shape of a dome, and the product discharge valve can be fitted at the apex of the dome. A gaseous or liquified propellant is introduced into the bottom of the can beneath the barrier to define the propellant chamber and this serves to pressurize the product within the can above the barrier.

As the product is expelled through the discharge opening, the barrier under pressure from below begins to evert into the upper region of the can to continually keep the product pressurized. The size or surface area of the barrier and the point along the height of the can at which it is secured to the can are chosen such that when the barrier is fully everted, its top surface is in contact with the peripheral side wall and with the upper cover of the can to ensure that substantially all of the product has been expelled from the can.

Other features and advantages of the invention will be apparent from the following description of the preferred embodiments illustrated in the accompanying drawings.

BRIEF DESCRIPTION OF THE DRAWINGS

FIG. 6 shows a first sealing ring embodiment for the barrier for providing the seal between the product and propellant chambers of the pressurized can.

FIG. 7 shows a second embodiment of such a ring.

FIG. 8 shows a third embodiment of such a ring and can construction for such purpose.

FIG. 9 shows an alternate embodiment of pressurized can in which the barrier is mounted directly to the can wall.

DETAILED DESCRIPTION OF THE PREFERRED EMBODIMENTS

Figure 1:
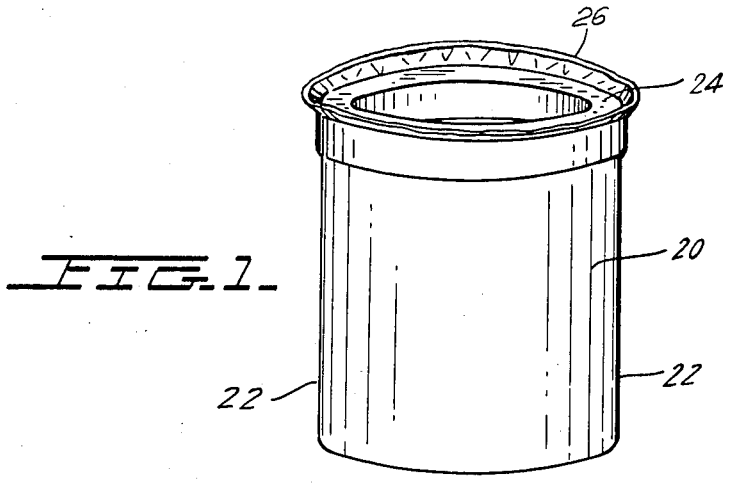
FIG. 1 shows a cup shaped barrier assembled with a sealing ring prior to insertion into the can body.
Figure 2:
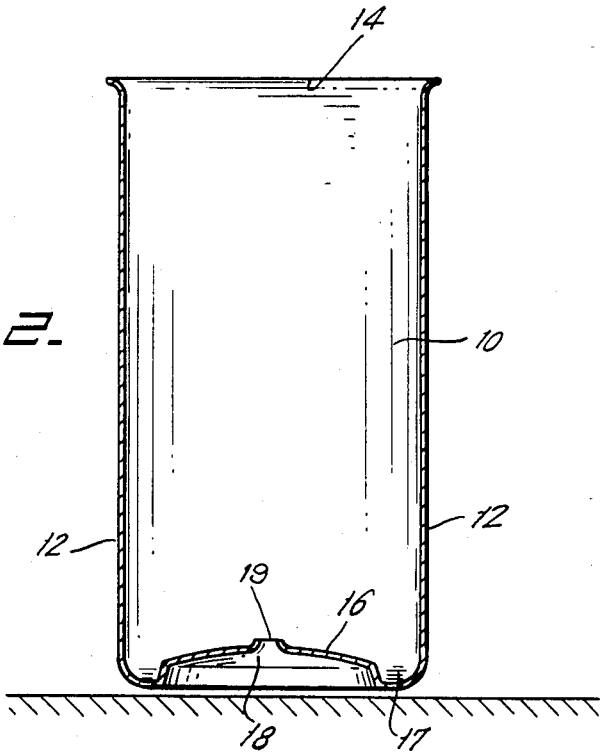
FIG. 2 shows the can body prior to the insertion of the barrier.

Referring to FIG. 2, the pressurizable can according to the invention includes an outer can 10 comprising a cylindrical body, defined by a cylindrical peripheral side wall 12, an open top 14, and a closed bottom 16 shaped to allow the pressurized can to stably rest on a flat surface. For strength, the can bottom 16 includes a peripheral rounded ridge 17 on whose crest the can sits, and a rounded depression 18. Other bottom shapes can be used to increase the strength of the can, and a number of such shapes are generally known in the art. The top of the depression has a pluggable hole 19 through it into the can. A gaseous or liquified propellant is conventionally supplied (from a source not shown) through the hole 19 after the top opening 14 has been closed so that the can may be pressurized. Thereafter, a plug 21 is installed in the hole 19 to close it.

The material of the can is typically metal. However, other materials like strengthened paper or plastic may be used, so long as it is strong enough to contain the pressure in a filled pressurized can. For safety, it is desirable often that the can be of metal.

For economic reasons, that is to reduce the amount of materials required in can fabrication, it is desirable to have thin walled cans. The can wall according to the invention is sufficiently thin that it expands when the can chamber is pressurized. The dimension of the can wall across the can chamber, such as the diameter of a cylindrical can wall, will increase in length. For example, at the lower pressures described below, the can wall may be made by a drawn and ironed process from sheet steel or even sheet aluminum giving a wall thickness of 0.0045–0.008 inch. It is even possible to use a steel can with a wall thickness of less than 0.0045 inch. In such a can which is sealed and under pressure, and where the temperature to which the can, its contents and the propellant therein are exposed is in the range of 30°–130° F., the pressurization of the can could cause an increase in its diameter of between 0.002–0.007 inch for temperatures of 30°–130° F., respectively. For a thin-walled can according to the invention, the diameter will increase by an increment which will be approximately one one-thousandth (1/1000) or more of its unexpanded value as it is pressurized to a pressure of 100 psi. If the diameter is 2.50 inches, the increment will be approximately 0.0025 inch or more. This increment is approximate in that it is within the scope of the invention for the increment to be a few ten-thousandths of an inch less than this value, depending on the particular alloy of the can.

It has been found that even a gap of 0.001 inch between the side wall of the can and a ring supporting a barrier in the can will permit leakage of propellant and/or product past the ring and barrier, which is undesirable. Therefore, the container according to the invention includes means for mounting the edge of the flexible barrier to the can wall and for sealing the mounting for preventing the product and propellant from leaking past the edge of the barrier as the can wall expands and returns to its unexpanded condition. This means may take any of several forms, as described below.

Because the propellant is not mixed with nor expelled with product from the can 10, the initial pressure and quantity of the propellant in the can need not be very high, and with some very fluent products and relatively larger discharge valve orifices, the can pressure can be quite low, e.g. 10–60 psig for low viscosity products, as compared with the conventional aerosol barrier can pressure of about 90–100 psig. This lower pressure helps to avoid stress on the seal and can wall, permitting use of thinner walls and simpler bottoms, but higher pressure, up to 120 psig or more, could also be used with cans whose walls and bottoms are designed to withstand this stress.

There are a variety of different propellants which may be placed in the pressure chamber, including various compressed gases or liquified gases. Where the propellant is a compressed gas, typically in an aerosol container, the compressed gas pressure chamber occupies in the range of $\frac{1}{3}$–$\frac{1}{4}$ of the total volume of the entire can. On the other hand, where the propellant is in the form of a liquified gas, the pressure chamber occupies in the range of 1/10–1/50 of the total volume of the can. It is economically desirable to produce a standard can design which can include a barrier that is adapted for either type of propellant, that is where the propellant chamber can be relatively smaller in volume or where it must be larger. The invention permits this.

Also, there is a wide variety of fluent products which may be contained in and expelled from the can 10, including quite fluent liquids of a viscosity of 10,000 cps or less and higher viscosity products like processed foods, e.g. cheese at a viscosity upwards of 300,000 cps or even higher, depending on the rheological properties of the product. Very low viscosity products, such as water and alcohol (1 cps or less) may also be contained and expelled.

Referring to FIGS. 1, 3–5, there is a barrier 20 in the can, which is shown in the shape of a cup. The barrier is a sheet of greater cross-section than the can, and the barrier sheet may be cut and folded so that the cup shape may be defined. Further, the sheet may have a pocket or generally tubular shape or it may be flat, although its surface area and shape are preferably such that the sheet will extend to the closed cover of the can, as described below. The cup shaped barrier has a side wall 22 and a closed bottom. The barrier may simply be a flat sheet whihch is deformed in use. It may be a sheet with cut regions which enable the sheet to be shaped into a cup, and the cut regions of the sheet are attached to the can at their margins. The cup is of a flexible material so that the cup may be filled and later everted as described below. The cup may also be made by vacuum forming or blow molding.

The material of the barrier 20 need merely be sufficiently ductile and flexible to evert as described below and be impervious to the product and to the propellant which contacts the barrier at its opposite sides. The material is preferably not a highly stretchable material like rubber, although some stretching may be desired. For example, an inexpensive plastic sheet or tube material of substantially uniform thickness and flexibility may be folded and heated to form a cup-shaped bag. Suitable plastics could include polyethylene, polypropylene, Mylar, Saran, and so forth. The barrier may be made of a paper, e.g. a waxed paper. It may be of any appropriate fabric. It could even be a metallic barrier, such as an aluminum film, or metallized plastic, such as aluminum on Mylar or Saran.

The means for mounting and sealing the barrier 20 to side wall 12 of can 10 may take several forms. In general, the mounting and sealing means must maintain the seal despite the expansion of the can. If can wall 12 is smooth and continuous, a seal may be more easily maintained, in most cases. The specific forms of the mounting and sealing means described below include ring seals as well as adhesives and melt sealing.

FIGS. 1 and 3–5 show a general ring seal embodiment in which a barrier fastening ring 24 is inserted into the barrier 20 and is positioned in the region near the upper edge 26 of the cup shape. The barrier 20 with its ring 24 are inserted into the can 10 and are positioned a distance down from the open top 14 of the can. The dimensions of the ring 24 and the barrier are selected such that the ring 24 can snugly fit against the peripheral side wall 12 of the can 10, thereby securing the barrier cup 20 firmly in the can. In this manner, the can 10 is divided by the cup into the upper product chamber 30 and the bottom propellant chamber 32.

The size and shape of the barrier are coordinated with the height of the can 10 and with the position of the ring 24 along the height of the can intermediate the upper and lower ends so that when the barrier is substantially fully extended, it will extend toward the bottom of the can and be substantially fully in contact with the peripheral side of the can when the can is loaded with the product and it will extend toward the top of the can and be substantially fully in contact with the side of the can and with the cover over the can when all the product has been expelled. Although barrier 20 could be slightly larger than the upper region, it is preferable that the barrier substantially fill the upper region of the can when fully everted, barely leaving some unfilled space, so that it cannot be pinched off by islanding caused by the propellant and so that nearly all of the product may be expelled. This makes it unnecessary to use a tube or other device to prevent pinch-off. Any suitable type of valve may be used in the discharge opening.

For use with liquified gas propellants, the initial volume of the upper product chamber 30 may be much larger than that of the bottom propellant chamber 32, on the order of 15 or 20 to one, thereby utilizing the majority of the space within the can body for the product. For use with compressed gas propellants, the initial volume of the product chamber 30 to the initial volume of the propellant chamber 32 would typically be on the order of 2 or 3 to 1. To accommodate these different chambers of different volume in a can of a standard size, and to enable the two chambers 30, 32 to have a correct volume relationship, it is desirable to be able to position the ring 24 and the barrier at appropriate selected positions along the height of the can wall.

As the invention is intended to assure complete expulsion of product in the chamber 30, the barrier size and shape are selected so that the barrier will press against the inside of the can cover on eversion to expel product, and the barrier will not be folded or wrinkled there but will instead be fully extended.

The two chambers 30, 32 are sealed off at the peripheral side wall of the can by the outward force exerted by the ring 24 on the wall 12. As the pressures in the product and propellant chambers are identical when the discharge valve 38 is closed and are nearly identical when that valve is open, the holding ring is not likely to move along the wall of the can.

After the product has been loaded in the product chamber 30 of the can 10 and the propellant has been loaded in the propellant chamber 32 of the can 10, the can is pressurized. The internal pressure in the can causes the side wall of the can to bulge slightly in diameter. For example, if the can 10 is of aluminum with a 2.5 inch diameter and with a wall that is 0.005 inch thick, when the can is pressurized to 60 psi at normal room temperature of 70° C., its diameter will increase approximately 0.004 inch. If this expansion is not compensated for, a radial clearance will be created between the interior of the can wall and the exterior of the ring 24. The radial clearance will provide a leakage path between the product and propellant chambers allowing gas and/or product to bypass the barrier cup 20, resulting in a pressure reduction in the can, leakage of propellant out of the valve of the can and inability to properly expel all of the product from the product chamber.

A number of ring seal embodiments described herein compensate for the bulging enlargement of the diameter of the can.

The first alternative is to provide the ring 24 with a preloaded, radially expansible, elastic seal against the can wall, so that even when the can expands as it is pressurized, the ring expands with the can and maintains the seal. As shown in FIG. 6, the ring 24 is provided on its periphery 42 with a vertically spaced array of annularly uninterrupted, resilient flanges 44, each with a diameter greater than the anticipated inside diameter of the can when it has been expanded under pressure. The flanges 44 are thin and flexible enough that as the ring 24 is installed in the can, the flanges 44 are deflected radially inwardly, that is, they are somewhat flattened against the periphery 42 of the ring. As the can wall expands upon pressurization, the resilient, somewhat flattened flanges resiliently deflect slightly outwardly to maintain their biased contact against the internal wall of the can for pressing the barrier against the can wall and maintaining the seal.

In the second embodiment of FIG. 7, in contrast, the ring 46 is of a different design. It is a solid, annular body with an exterior peripheral channel 48 which opens radially outwardly. The channel receives and holds in it an elastic, resilient, compressible sealing element 50, illustrated as an O-ring. The diameter of the sealing element ring 50 is slightly greater than the internal diameter of the can, even when the can has stretched under pressure. When the ring 46 with the captive O-ring 50 in the channel 48 is installed in the can, the O-ring 50 is compressed through its engagement against the can wall. As the can wall expands under pressure, the resilient ring 50 tends to restore itself to its undeflected condition and is biased outwardly against the barrier and the can wall for maintaining the seal there.

The third embodiment shown in FIG. 8 uses a different approach to accomplish the same result. The above described thin, metal can wall is slightly deformable under pressure. If the can wall is only slightly deformed, at less than the degree of deformation which will permanently deflect the can wall from its normal profile, the normal resilience of the metal can material will tend to restore the wall to its original undeflected shape. (This is what occurs as the can is pressurized to a normal extent and is gradually depressurized through use.) As shown in FIG. 8, the annular ring 54 inside the can 10 has an outer periphery 56 with a diameter that is only slightly greater than the diameter of the can wall even when that wall is pressurized. As a result, when the ring 54 is installed in the can, it does not unduly stretch and deform the can wall. The can wall therefore does not assume a new, deformed shape. Instead, the can wall yields slightly as the ring is moved along the can wall until it is finally lodged in a selected position. The resilient, but not permanently deformed can wall maintains a tight seal with the ring and prevents leakage past the ring between the can chambers.

The ring 54 is sized so that it stretches the can wall larger than the diameter to which the can would expand at maximum loaded pressure and maximum anticipated temperature, but less than the yield point of the can material. For example, if an aluminum can with a 2.50 inch inner diameter and with 0.005 inch thick wall is pressurized to 60 psi at 70° F., it expands approximately 0.004 inches in diameter, to an inner diameter of 2.504 inches. This will create a hoop stress of approximately 15,000 psi. The ring 54 has its periphery sized to expand the can wall by at least about two to four one-thousandths (2/1000–4/1000) from its unexpanded diameter, and may expand it to 2.509 inch diameter, for example. This expansion, referred to as interference, results in a seal which is maintained as the can expands under pressure. This will also create a hoop stress in the area of the ring of approximately 33,750 psi, which is still well below the yield point of the aluminum can material and of the ring. Even if the internal pressure in the can is raised to 100 psi at 70° F., this will only expand the can to approximately 2.507 inch, with a hoop stress of 25,000 psi. Under all expected circumstances to which the can may be exposed, the can will, therefore, not expand so that its inner diameter is greater than the outer diameter of the periphery 56 of the ring. Good sealing contact will thereby be maintained and bypass of the ring between the two chambers is avoided.

The above techniques of maintaining a seal rely upon the elasticity of at least one of the can and ring for maintaining the seal, with the first mentioned techniques of FIGS. 6 and 7 using the resilience of the ring to maintain the seal and the latter technique of FIG. 8 using the resilience of the can to maintain the seal.

Figures 3, 4, 5:
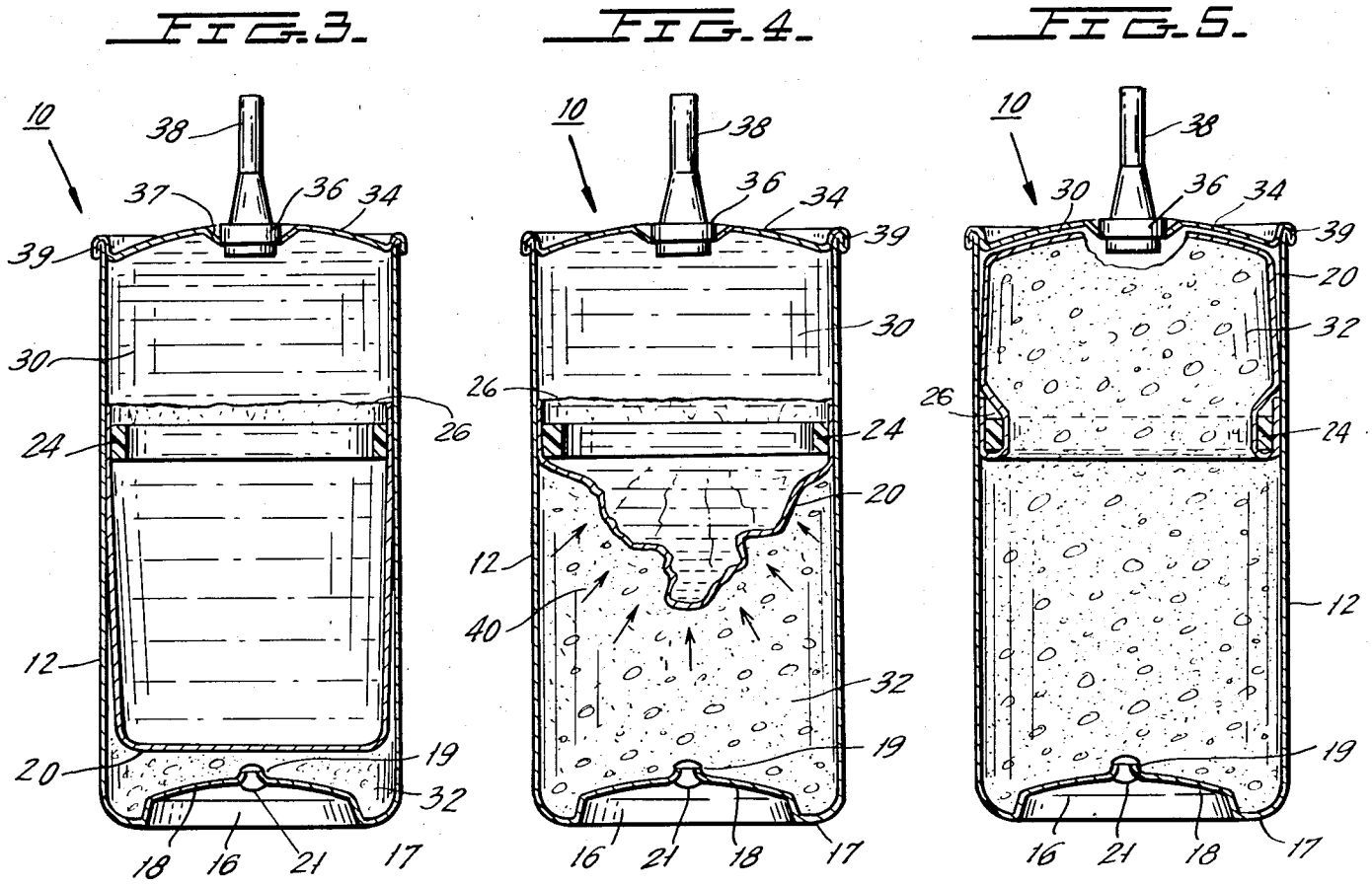
FIG. 3 is a cross-sectional, elevational view showing a pressurized fluent material containing and dispensing can having in it a barrier according to a preferred embodiment of the invention.
FIG. 4 shows the pressurized can after it has been filled with product and sealed with a top cover and after a small quantity of product has been expelled from the can.
FIG. 5 shows the can and barrier after all the product has been expelled.

A completely assembled pressurized can with a ring seal according to the invention is shown in FIG. 3. The upper cover 34 closes off the top opening 14 of the can. The cover 34 is shown dome shaped and has an apex 36 with a hole 37 through it in which a hole sealing, product discharge valve 38 is affixed. The cover is crimped to the chime 39 at the top of the can.

The can is filled with a fluent product through the hole 37 before the discharge valve 38 is emplaced. This moves the barrier 20 down to the bottom of the can and defines and completely fills the barrier 20 and the product chamber 30. The can is filled with product to the underside of the cover 34, i.e. until it is completely filled. Then the discharge valve 38 is emplaced, which closes the hole 37. The discharge valve may be a known tilt operated valve (or any other valve suitable for the purpose), and its seals the product chamber when it is closed. Next, the propellant chamber 32 is filled with a gaseous, or liquified propellant through the hole 19. When the desired pressure level or quantity is attained, the gaseous pressure supply or liquified propellant is removed and the hole 19 is plugged by a plug 21. The can is now ready for operation.

The can in FIG. 4 is shown at a stage after a portion of the product has been expelled from the can through the valve 38. The barrier 20 is shown partially everted due to the propellant as the barrier assumes a shape defined by the remaining product.

Because the barrier is mounted to the peripheral side wall 12 at a height which is near the middle of the can 10 with its cover on, the barrier moves from extending downward into the can, is deflected up past the ring 24 and finally everts and extends upward into the cover 34, as substantially all the product is finally expelled, as shown in FIG. 5. This eversion prevents the barrier from pinching-off or islanding which would prevent expulsion of the product due to some product being captured in a pinched-off region of the barrier.

The barrier cup is so shaped and the ring 24 is so positioned that when the barrier 20 is fully everted as shown in FIG. 5, it substantially fills the space bounded by the cover 34 and the side wall 12 of the can located above the fastening ring 24. When the product chamber 30 is filled before product is expelled, the barrier fills a portion of the space bounded by the container bottom 16 and the side wall of the can. This assures that almost the entire volume which is bounded by the walls and bottom of the can 10, besides that volume needed for propellant, may be filled with the product and that all of the product is usefully expelled from the can when the barrier has been fully everted.

The sealing effectiveness can be increased through the introduction of sealing compounds between the fastening ring and the barrier and/or between the barrier and the can wall.

As the pressure differential across the barrier is usually quite small, it may alternatively be sufficient to secure the barrier cup 20 directly to the can wall without a ring 24. Other means for mounting and sealing the barrier may be used for directly mounting the barrier to the can wall at a seal 64 as shown in FIG. 9. Seal 64 may be obtained with a ring of adhesive applied directly between the entire upper edge of the barrier and the can wall or by a melt process in which the upper edge of the barrier is melted and sealed to the can wall. This arrangement still must compensate for the anticipated expansion of the can wall under pressure and its return to the unexpanded condition.

If an adhesive is used to form seal 64, the adhesive substance and the upper edge 62 of the barrier must together be sufficiently expansible and contractable to compensate for change in can diameter. Any suitable adhesive which provides a sufficient bonding force to maintain the seal may be used, including rubber cement, glue and hot melt glue. The barrier may be a stretchable material such as polypropylene.

If a melt process is used to form seal 64, upper edge 62 of the barrier must alone be sufficiently expansible and contractable to compensate for can diameter chambe. The melt process may employ thermal, sonic, or radio frequency heating. The barrier may be polyethylene or polypropylene or any other suitable material. Again, it is necessary to obtain a sufficient bonding force to maintain the seal. The barrier and the adhesives must be capable of stretching as needed without tearing and without tearing away from the periphery of the can.

The invention simplifies production of the can and its product-propellant barrier and eliminates concern about close manufacturing tolerances for the barrier and for its attachment to the can. For example, in previous barrier pack cans, which employ a piston barrier system, or in the bag barrier system with folded or pleated bag side walls to enable the bag to collapse without pinch-off, the consistent predictable shape of the can 10 was critical to the operation of the barrier system. With a piston system, an indentation in the container above the piston would prevent the piston from traveling up the peripheral side wall of the can. With the present barrier system, however, the container can be of almost any size or shape. It is not even necessary that the peripheral side walls of the container be generally parallel to each other as with other known systems. Consequently, cans could be used with either esthetically pleasing shapes or other shapes which are designed in accordance with human factor engineering principles.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A pressurizable container for containing a fluent product under pressure and for dispensing the product through a discharge opening, said container comprising:

a can wall surrounding and defining a can chamber and having an upper end with the discharge opening defined therein and an opposite lower end; the can wall being resilient and expanding slightly when the can chamber is pressurized and returning to an unexpanded condition as the pressure in the can chamber is reduced to zero; the can wall having a dimension across the can chamber which increases by at least approximately one one-thousandth (1/1000) of its value in the unexpanded condition as the pressure in the can chamber goes from the unexpanded condition to a pressure of 100 psi;

a flexible barrier having an edge mounted to the can wall in the can chamber, the barrier dividing the can chamber into a product chamber comprising a part of the can chamber between the barrier and the upper end of the can wall for containing a fluent product to be stored and dispensed and a propellant chamber comprising a part of the can chamber between the barrier and the upper end of the can wall for containing a propellant adapted to provide pressure upon the barrier to urge the barrier into the product chamber for expelling the product through the discharge opening; the barrier comprising material that is impervious both to the product and propellant; and means for mounting the edge of the flexible barrier to the can wall in a manner that seals the barrier to the can wall for preventing the product and propellant from leaking past the edge of the barrier as the can wall expands and returns to the unexpanded condition;

the flexible barrier being extendible toward the lower end when the product chamber is initially filled with fluent product and being gradually extensible toward the upper end through pressure generated by propellant in the propellant chamber to expel the fluent product out of the can chamber through the discharge opening.

2. The container of claim 1 in which the barrier has a size and shape and is mounted to the can wall so that the barrier substantially fills the upper end of the can wall and meets the top cover when fully expanded toward the upper end for expelling substantially all of the product from the product chamber.

3. The container of claim 2 in which the barrier is a cup-shaped bag which everts as it extends toward the upper end.

4. The container of claim 3 in which the cup-shaped bag is of substantially uniform thickness and flexibility.

5. The container of claim 3 in which the bag comprises a material selected from the group of plastic sheet material, metallized plastic sheet material, and metallic film.

6. The container of claim 2 in which the can wall further comprises a top cover portion at its upper end, the top cover portion and the upper end of the can wall defining an upper end surface, the barrier having a size and shape and being mounted to the can wall so that it is at most slightly larger than the upper end surface for preventing pinching off of some of the product when the barrier is fully extended toward the upper end.

7. The container of claim 1 in which the can wall has a smooth continuous inner surface.

8. The container of claim 1 in which the mounting means comprises an adhesive, at least one of the adhesive and the barrier being expansible and contractable for maintaining a seal.

9. The container of claim 1 in which the mounting means comprises a melt seal of a part of the barrier to the can wall, the barrier being sufficiently expansible and contractable to maintain a seal.

10. The container of claim 1 in which the can wall is cylindrical and the mounting means comprises a ring mounted inside the edge of the barrier and holding the barrier in a sealed manner against the can wall, at least one of the ring and the can wall being sufficiently resilient to deform resiliently upon mounting the ring in the can wall to create a seal and also to resiliently press the ring against the can wall to continue to maintain the seal as the can wall expands.

11. The container of claim 10 in which the ring has a periphery facing toward the can wall; the ring having expansible-contractable means at the periphery thereof for engagement with the can wall, and the ring being of a size with respect to the diameter of the can that the expansible-contractible means are deflected and contracted upon mounting of the ring and the barrier in the can chamber while the can chamber is unpressurized and the expansible-contractable means being adapted for expanding to maintain the seal between the periphery of the ring and the can wall upon the can chamber being pressurized and the diameter of the can wall increasing slightly.

12. The container of claim 11, wherein the expansible-contractable means comprises an annular, deflectable flange on the periphery of the ring.

13. The container of claim 12, wherein there are a plurality of the flanges on the periphery of the ring arranged above each other along the height of the ring.

14. The container of claim 11, wherein the expansible-contractable means comprise a compressible, resilient element supported at the periphery of the ring for expanding into continuous sealing engagement with the can wall.

15. The container of claim 14, wherein the ring includes an annular groove at the periphery thereof and the compressible, resilient element comprises an additional ring around the first-mentioned ring and supported in the groove in the first-mentioned ring.

16. The container of claim 10, wherein the ring has a diameter which is slightly greater than the diameter of the wall when the ring is in the can wall and the can chamber is not pressurized, for slightly deflecting the can wall without permanently deforming it; the diameter of the ring with respect to the diameter of the can wall being selected such that when the can chamber is pressurized and the can wall thereby increases in diameter, the ring diameter still remains greater than the diameter of the can wall, for thereby maintaining the seal between the ring and the can wall.

* * * * *